US006616365B1

(12) United States Patent
Vann

(10) Patent No.: US 6,616,365 B1
(45) Date of Patent: Sep. 9, 2003

(54) TELESCOPIC WRITING INSTRUMENT

(76) Inventor: Charles S. Vann, 1425 Drake Ave., Burlingame, CA (US) 94010

( * ) Notice: Subject to any disclaimer, the term of this patent is extended or adjusted under 35 U.S.C. 154(b) by 0 days.

(21) Appl. No.: 10/334,418

(22) Filed: Dec. 31, 2002

(51) Int. Cl.[7] ..... B43K 7/12
(52) U.S. Cl. ..... 401/117; 401/99
(58) Field of Search ..... 401/131, 117, 401/99, 195

(56) References Cited

U.S. PATENT DOCUMENTS 1,580,183 A * 4/1926 Veillette ..... 401/117
4,601,599 A 7/1986 Katoh
6,474,889 B2 11/2002 Kato

* cited by examiner

*Primary Examiner*—David J. Walczak

(57) ABSTRACT

The telescopic writing instrument has adjustable length for comfortable writing when extended and ease of transport when contracted. It consists of a pen or pencil cartridge fixed inside the inner substrate of three concentric substrates that slide within each other.

In its extended length, the instrument is standard length with the fingers holding one end of the instrument, and the other end leaning comfortably against the base of the hand. In its contracted configuration, the instrument is about half-length with the outer substrate extended over the pen or pencil cartridge to prevent unintended markings.

The instrument is simple and easy to use, reconfiguring in about one second.

1 Claim, 2 Drawing Sheets

TELESCOPIC WRITING INSTRUMENT

CROSS-REFERENCE TO RELATED APPLICATIONS

Application Number U.S. Pat. No. 6,283,657 B1, dated Sep. 4, 2001 and titled "Adjustable-Length Writing Instrument".

BACKGROUND

For the purpose of comfort, a typical writing instrument is around six inches in length such that one end can be supported by a combination of fingers and the other end supported on the base of the hand between the thumb and first finger. A writing instrument much shorter than the standard length is not long enough to be supported by the base of the hand. Grasping with the fingers alone, it is difficult, awkward, and tiring to control the instrument, making it generally an unacceptable design.

However, the standard-length writing instrument has a fundamental problem in that it is generally too long and too rigid for easy storage on a person. Often the most convenient storage area on a person is a clothes pocket. But, the standard shirt pocket is smaller in both dimensions that a standard writing instrument, causing it to protrude from the pocket. For fashion and practical reasons (it can fall out or snag things), most users do not want a writing instrument protruding from their shirt pocket.

Pants pockets are generally long enough to hold the entire length of a standard instrument, but the instrument can cause discomfort and damage when the user sits down with the instrument in the pocket. For the same reasons, a standard length instrument is too long and rigid to fit inside a man's wallet, small notebook, electronic devices such as calculators and personnel digital assistants (PDAs), and some women purses.

Therefore, a writing instrument is needed that is standard length during use but can be made much shorter and smaller for storage. Folding is one means of making a pin long for operation but shorter during storage (for example, U.S. Pat No. 4,149,812 to Huffman, Jr and U.S. Pat. No. 5,988,918 to Johnson). However, a folding instrument as described by Huffman does not reduce its volume only its length, and the user is not fully protect against inadvertent marking in its closed configuration. The folding instrument described by Johnson does not reduce volume either and is awkward and impractical to fold into a shorter length.

SUMMARY

In accordance with the present invention, a writing instrument is adjustable in length such that it is a comfortable and practical length when writing but it easily contracts to a much shorter length and smaller volume for easy storage.

DRAWING FIGURES

Reference is now made to the embodiment illustrated in FIGS. 1–4 wherein like numerals are used to designate like parts throughout FIG. 1 is an isometric view of the telescopic writing instrument in its extended and operational mode.

Reference Numerals in Drawing

Figure 1:
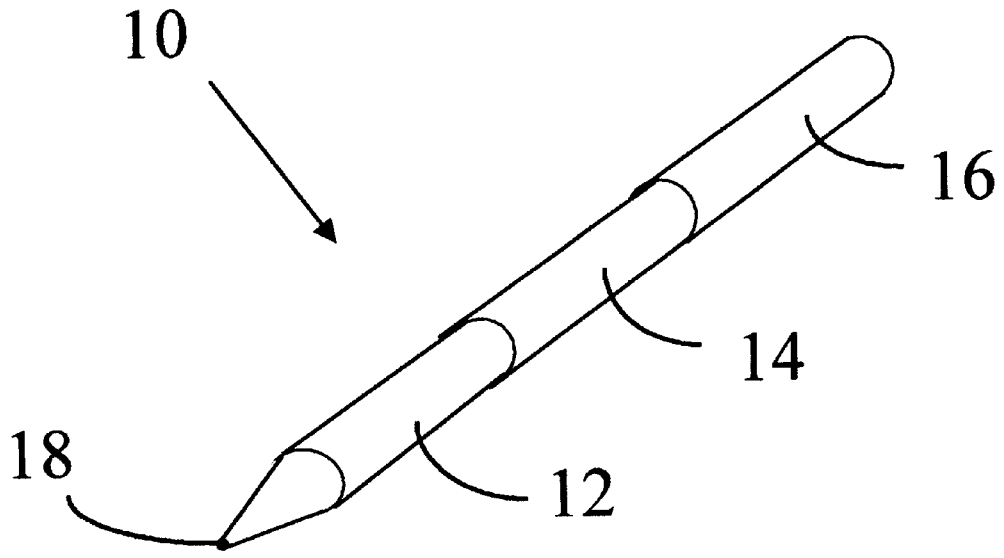

10 embodiment
12 inner substrate
13 middle substrate
16 outer substrate
18 pencil or ink cartridge
30 Extension-stop bevel on middle substrate
32 Compression-stop bevel on middle substrate
34 Extension-stop bevel on outer substrate
36 Compression-stop bevel on outer substrate

DESCRIPTION

Figure 2:
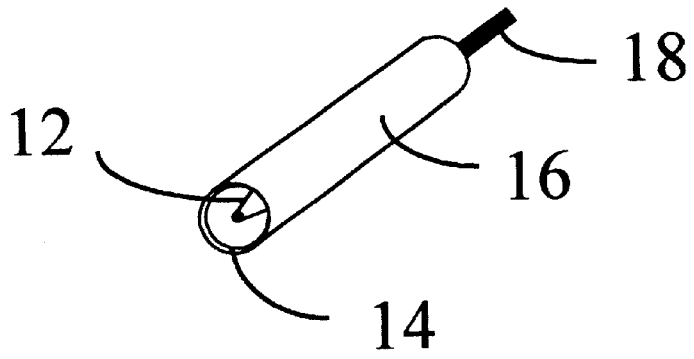
FIG. 2 is an isometric view of telescopic writing instrument in its contracted and storage mode.
Figure 3:
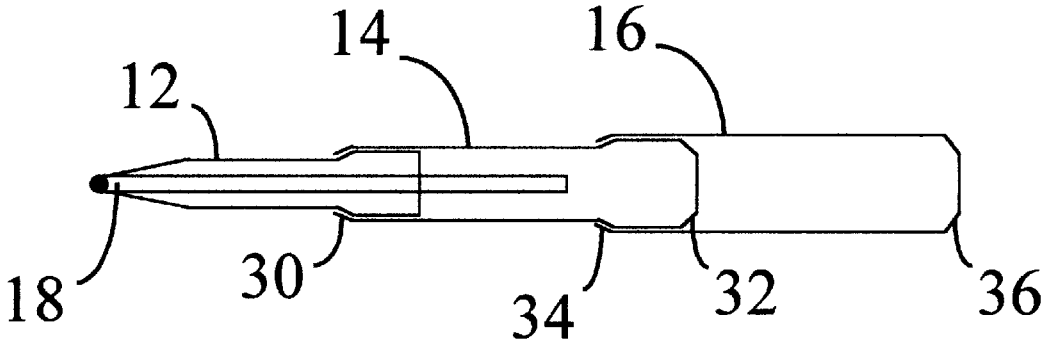
FIG. 3 is a cut away view of the telescopic writing instrument in its extended and operational mode.
Figure 4:
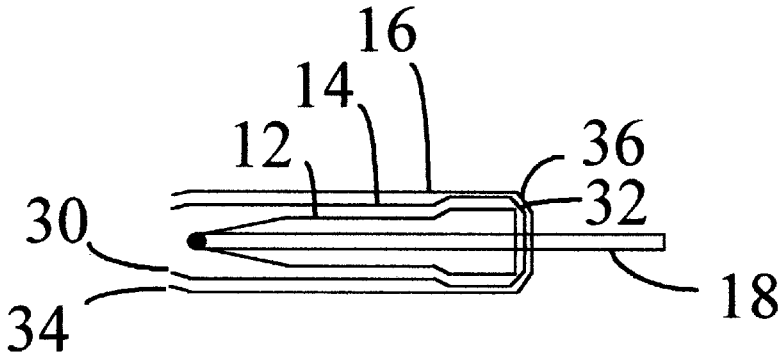
FIG. 4 is a cut away view of telescopic writing instrument in contracted and storage mode.

The embodiment of the telescopic writing instrument is illustrated in FIGS. 1,3 (extended and operational mode) and FIGS. 2,4 (contracted and storage mode).

The embodiment 10 consists of three substrates: inner substrate 12, middle substrate 14, and outer substrate 16: Inner substrate 12 slides inside middle substrate 14, and middle substrate 14 slides inside outer substrate 16. Inner substrate 12 contains a means of writing 18 such as a pencil or ink-cartridge. Substrates 12,14 are slightly larger in diameter at one end compared to the other end.

Substrates 14,16 have both ends beveled towards their axis to prevent the substrates from coming loose during reconfiguration. Middle substrate 14 has an extension-stop bevel 30 and a compression-stop bevel 32, and outer substrate 16 has an extension-stop bevel 34 and a compression-stop bevel 36.

OPERATION

Writing with the telescopic writing instrument 10 is the same as with a standard writing instrument. The hand supports and moves the instrument across a surface to write.

However, to contract the instrument, the operation is different. The user holds inner substrate 12 with one hand and outer substrate 16 with the other hand, pushing inner substrate 12 inside middle substrate 14 until inner substrate 12 slides into compression-stop bevel 32 on middle substrate 14, and middle substrate 14 slides into contact with compression-stop bevel 36 on outer substrate 16. Pencil or ink cartridge 18 will extend outside outer substrate 16.

To extend the instrument, the user holds outer substrate 16 with one hand and pushes cartridge 18 into outer substrate 16 until the user can grab inner substrate 12 with the other hand. Then, the user pulls inner substrate 12 until it slides into contact with extension-stop bevel 30 on middle substrate 14 and middle substrate 14 slides into contact with extension-stop bevel 34 on outer substrate 16.

ADVANTAGES

From the description above, a number of advantages of the telescopic writing instrument are evident:

In its extended arrangement, the instrument is standard length for comfort to the fingers on one end and comfort to the base of the hand on the other end. In its contracted arrangement, the instrument is much shorter than standard length (about half) and smaller in volume (about a third), allowing it to easily fit horizontally at the bottom of a shirt or pants pocket. At the bottom of a pocket, it is not seen but also does not cause discomfort or damage when the person sits.

The instrument is simple with only four parts, reducing the chances of breaking, jamming, or wearing-out, and all parts are permanently connected, avoiding loss of parts (such as a cap).

In its contracted configuration, the writing part of the cartridge is fully covered by the outer substrate, preventing unintended markings.

The instrument is easy to reconfigure. In about one second, the user can reconfigure the instrument from contracted to extended or visa versa.

CONCLUSIONS, RAMIFICATIONS, AND SCOPE

This invention is an advanced concept for a comfortable, standard-length writing instrument that can be quickly contracted into about half-length for easy and practical storage. This instrument can be stored and used in places not possible with a typical writing instrument.

This invention may be embodied in other specific forms without departing from the spirit of essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An extendable instrument for writing comprising:

an outer substrate, a middle substrate slidably mounted within said outer substrate, an inner substrate slidably mounted within said middle substrate and having a writing cartridge attached thereto such that a writing tip on said writing cartridge protrudes from one end of said inner substrate in order to enable a user to write with said writing instrument whereby when said inner substrate is slid into said middle substrate and said middle substrate is slid into said outer substrate, said writing instrument is placed in a contracted position with an outer end of said writing cartridge extending from a rear end of the outer substrate and wherein when a user pushes said outer end of said writing cartridge into said outer substrate, said inner substrate is extended from said middle substrate in order to enable a user to grasp said inner substrate and thereby fully extend said inner substrate from said middle substrate and said middle substrate from said outer substrate to thereby fully extend said writing instrument.

* * * * *